United States Patent [19]

Paige

[11] 3,983,653

[45] Oct. 5, 1976

[54] ROTARY DISSEMINATOR

[76] Inventor: Richard E. Paige, 215 E. 68th St., New York, N.Y. 10021

[22] Filed: Dec. 19, 1973

[21] Appl. No.: 425,996

[52] U.S. Cl. ..... 40/138; 40/39

[51] Int. Cl.[2] ..... G09F 19/02

[58] Field of Search ..... 40/138, 39, 128; 46/53, 46/57, 58

[56] References Cited

UNITED STATES PATENTS

| | | | |
|---|---|---|---|
| 231,983 | 9/1880 | Belknap | 40/39 |
| 1,561,830 | 11/1925 | Connel | 40/39 |
| 1,899,788 | 2/1933 | Baldwin | 46/53 |
| 2,803,905 | 8/1957 | Garver | 46/53 |
| 3,085,545 | 4/1963 | Ore | 46/53 X |
| 3,221,440 | 12/1965 | Gutierrez | 46/53 |
| 3,359,670 | 12/1967 | Pyc | 40/39 |
| 3,762,084 | 10/1973 | Jones | 40/138 |

FOREIGN PATENTS OR APPLICATIONS

| | | | |
|---|---|---|---|
| 171,500 | 6/1952 | Austria | 46/57 |
| 853,854 | 10/1952 | Germany | 40/39 |
| 6,564,429 | 10/1963 | Italy | 40/39 |
| 935,997 | 9/1963 | United Kingdom | 40/39 |

*Primary Examiner*—Hugh R. Chamblee
*Assistant Examiner*—Wenceslao J. Contreras
*Attorney, Agent, or Firm*—Finnegan, Henderson, Farabow & Garrett

[57] ABSTRACT

A rotary disseminator is disclosed which is responsive to even minute vertical air currents. The disseminator is a perfectly balanced vaned rotor supported for rotation about a vertical axis by a filamental shaft.

8 Claims, 6 Drawing Figures

ROTARY DISSEMINATOR

BACKGROUND

This invention relates to self-contained rotor disseminators and, more particularly, to a disseminator of information and vapor which is caused to rotate about a vertical axis by minute vertical air currents.

Vertical air currents are present in most inhabited rooms as a result of heating sources and cooling devices. Many sources of heat exist which are unappreciated and which previously have not been utilized as a power source for moving objects. One of the most common sources of heat is the human body which produces vertically rising air currents in the vicinity of the body as a result of the body heating the air immediately adjacent to it, which air usually is cooler than the human body. The warmed air then rises because of its lower density. Substantial vertical air currents are generated in most commercial establishments; such as supermarkets, enclosed shopping malls and exhibition halls, because of the large number of people present, each of whom is heating the ambient air. Substantial vertical air currents are also produced by cigarettes and other smoking articles, lamps and a myriad of other objects whose temperature is higher than that of the surrounding atmosphere. Downwardly moving air currents also exist by virtue of heavy cool air emitted from ceiling high air conditioning vents.

It is well recognized in the advertising field that a moving object attracts the eye much more quickly than does a stationary object. Preferably, the movement should be relatively slow in order to permit full comprehension of the message being conveyed by the moving object. For many reasons it is preferred that the movement be produced without the need for a source of electrical energy thereby enabling placement of the advertisement at any desired location regardless of whether or not an appropriate electrical outlet is available. Of course, elimination of the need for electrical energy also permits use of a moving advertisement without the electrical expense involved in powering it.

This invention is a rotating device designed to utilize, as its source of power, the hitherto undiscovered usefulness of undirected, unconcentrated micro-radiations and minute air currents from natural heat sources. These imperceptible, random, helter-skelter bits of wasted energy, are effectively utilized by the receptive vanes of the device, and given useful direction.

The device of this invention is called a Rotor-Sensor; Sensor, because it senses and responds to micro-impulses; Rotor, because it responds to the impinging impulses through rotory motion.

Of critical importance to the Rotor Sensor is its perfect balance, and its suspension from a relatively long, flexible, twistable "shaft" of filament such as a thread. Its vanes, to gather power from so small a source as micro-radiations and minute air currents, must be large. The impulses twist the device about its axis or shaft, and thus minutely raise it as the thread twists. When the impulses terminate the "shaft" untwists, for many minutes, and thus readies itself to receive the next affecting impulses to come its way.

The very presence of a cashier at a cash register will cause a Rotor-Sensor above his head to revolve. People in an Exhibition Hall, passing beneath a Rotor-Sensor even three feet in diameter, and weighing several pounds, will power it so that it will slowly turn and show its large and useful panels successively. Because of this ability, the Rotor-Sensor, while too weak to do enough actual, physical work, to justify its existance, can, nevertheless, serve to exhibit signs and display material, which is valuable to advertisers or those wishing to make announcements. This type of utilization of the Rotor-Sensor in no way impedes its mechanical motion nor does it subject it to anything or any resistance, only to visual examination.

There is a clear line of demarkation delineating the division between the Rotor-Sensors and any wind-driven, propeller action, sign or device, or, the various forms of heat-motors with their source of concentrated, directed power. The sources of power for the Rotor Sensors emanate from natural, unintentional sources, such as radiations of heat from people; from lights; from sunlight; from store or home heat radiators; from cold air falling from air conditioning outlets (near ceilings).

One version of the Rotor-Sensor is in the form of a suspended panel onto which is mounted a deodorant or other volatile substance for removing undesired odors from hospital rooms, nursing homes, etc. (medicinal odors or body odors). The vanes are rotated as a result of the heat generated by the patient lying beneath it, in his bed, effecting the spreading of the deodorizing fumes about the room.

Accordingly, it is a primary objective of this invention to provide a new and improved self-contained rotary device which utilizes vertical air currents conventionally available in an inhabited, enclosed room, which device can be used for disseminating information or vapor.

Another objective of this invention is to provide a self-contained rotary disseminator which is inexpensive to manufacture, which can be formed of sheet material and shipped and stored in flat, compact form and which is readily assembleable into a usable shape at its point of usage.

Additional objectives and advantages of the invention will be set forth in part in the description which follows and in part will be obvious from the description, or may be learned by practice of the invention. The objectives and advantages of the invention may be realized and attained by means of the instrumentalities and combinations particularly pointed out in the appended claims.

BRIEF DESCRIPTION OF THE INVENTION

To achieve the foregoing objectives and in accordance with the purpose of this invention, as embodied and broadly described herein, the rotary disseminator of this invention comprises a body, means for suspending the body from a support for rotary motion about a vertical axis, at least two evenly spaced vanes extending from said body and having substantially identical effective surfaces forming an acute angle with a horizontal plane, wherein vertically moving air currents impinging upon the vane surfaces effect rotation of the disseminator.

Preferably, the means for suspending the body is a member having a fixed distal end and a proximal end attached to the body, rotation of the body in a first direction effecting rotation of the proximal end relative to the distal end producing an increasing biasing force in the member in a second direction opposite to the first direction such that upon termination of the application of torque to the member by the body, the member causes the body to rotate in that second direction.

It is also preferred that in use of the disseminator as an information disseminator, at least three and less than five evenly spaced planar vanes or display panels extend from the body with each of the surfaces of the panels bearing a message thereon. When the disseminator is used for disseminating vapor, means are mounted on at least one of the body end panels for storing a volatile liquid and enabling the liquid to vaporize such that the rotational movement of the disseminator establishes rotational air currents in the vicinity of the disseminator to effect dissemination of the resulting vapor.

The invention consists in the novel parts, construction, arrangements, combinations and improvements shown and described. The accompanying drawings, which are incorporated in and constitute a part of the specification illustrate several embodiments of the invention and, together with the description, serve to explain the principles of the invention.

DETAILED DESCRIPTION OF THE INVENTION

Reference will now be made in detail to the present preferred embodiments of the invention, examples of which are illustrated in the accompanying drawings.

The rotary disseminator of this invention is designed to utilize minute air currents and micro-forces which are normally available in any inhabited enclosed area, preferably in areas which are relatively draft-free, in order that the disseminator has primarily only one degree of movement, namely rotation about a vertical axis. The disseminator is also designed so that it may be easily and inexpensively manufactured, shipped to its point of display in packages of flat minimal size and easily and rapidly assembled.

Figure 1:
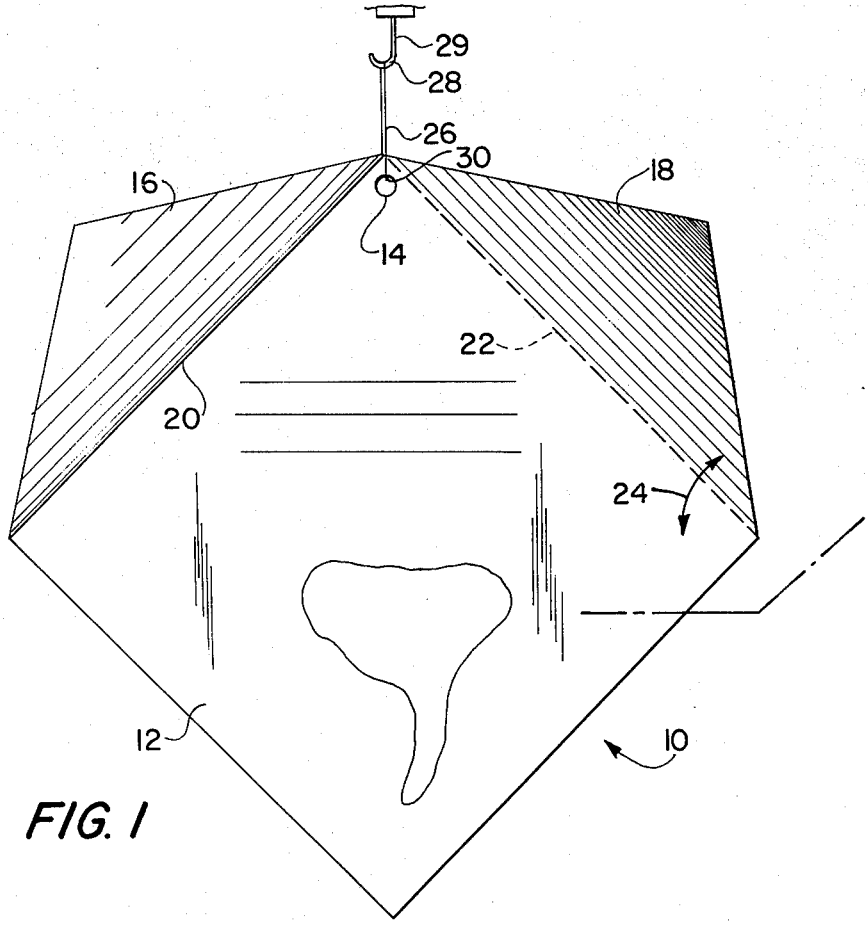
FIG. 1 is a perspective view of a simplified rotary disseminator formed in accordance with this invention.

Referring now to FIG. 1, there is illustrated a rotary disseminator 10 formed in accordance with the simplest form of this invention and which comprises merely a body, a means for suspending the body from a support for rotary motion about a vertical axis and two substantially identical evenly spaced vanes extending from the body with the vanes forming an acute angle with a horizontal plane. As here embodied, the body 12 of the disseminator 10 may be formed as a planar member, such as of paperboard, having an opening 14 formed adjacent the upper end thereof. While a diamond shape is illustrated in FIG. 1, any convenient or desirable shape or size may be employed since the body 12 itself does not participate in the production of the rotary motion. A pair of vanes or panels 16, 18 are shown extending from opposed upper edges 20, 22 respectively of the body 12, the vanes 16, 18 extending in opposite directions from the body. For example, as illustrated in FIG. 1, the vane 18 extends forwardly (out of the paper) while the vane 6 extends rearwardly (into the paper). The vanes 16, 18 have substantially identical effective surfaces since the surface areas are equal and the center of pressure of the vanes are equidistant from the axis of rotation of the disseminator providing a precisely balanced rotor. Each vane forms an acute angle 24 with a horizontal plane in order to utilize the vertically moving air currents to provide rotary motion. If the vanes extend from the body horizontally, the upward air currents would tend to elevate the disseminator 10 rather than rotate it and, since the currents are relatively minute, they would produce no motion. If the vanes extended from the body 12 with their surfaces vertically oriented, the vertical air currents would have an insubstantial surface to react upon and again no motion would result. While any acute angle 24 would produce rotary motion of the disseminator 10, it has been found that the most efficient acute angular orientation of the vanes is 45°.

In accordance with this invention, the disseminator 10 is suspended from a vertical support by a member which permits rotary motion about a vertical axis and which is substantially friction-free. As here embodied, an elongated filamental shaft, such as a thread 26, is attached at its distal end 28 to any suitable support, such as a hook 29 mounted on the ceiling. The proximal end 30 of the thread 26 is attached to the body 12. A simplified attachment is accomplished by merely looping an elongated piece of thread through the opening 14 as can be seen in FIG. 1.

Vertical air currents, such as is caused by a person standing beneath the disseminator 10, will impinge upon the vanes 16, 18. Since these vanes extend in opposite directions, the force vectors produce a torque about a vertical axis through the center of the disseminator 10 effecting rotation of the disseminator 10 about that vertical axis. The thread, being elongated, flexible and limp, provides virtually no resistance to the rotation and permits even the minute air currents caused by a single person to rotate the disseminator 10. Since the disseminator 10 rotates in one direction as a result of rising hot air currents and rotates in that same direction as a result of descending cold air currents, the proximal end of the thread is attached directly to the disseminator 10, the proximal end 30 rotates relative to the distal end 28 causing the thread 26 to twist as the disseminator rotates. Twisting of the thread also causes the disseminator to rise vertically slightly. Upon cessation of the vertical air currents, gravity and the biasing force produced by the twisted thread will effect rotation of the disseminator in the opposite direction to unwind the thread slowly thereby producing almost constant rotary motion to the disseminator without the need for an external energy supply.

Figure 2:
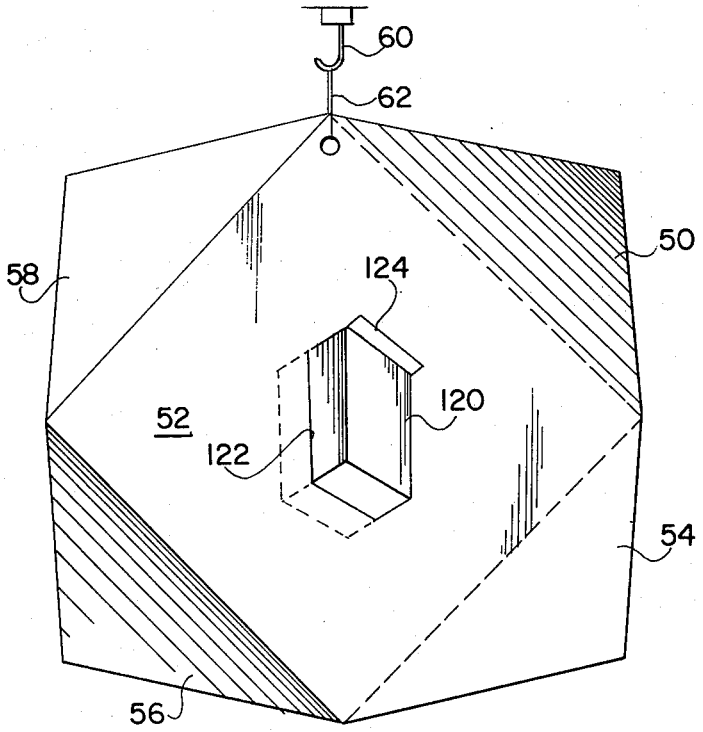
FIG. 2 is a perspective view of a modification of the rotary disseminator of FIG. 1.

FIG. 2 illustrates a modified form of the disseminator illustrated in FIG. 1. The disseminator 50 of FIG. 2 is formed with a planar body 52 having four vanes or panels extending therefrom. The vanes alternate in the direction in which they extend from the body 52 in a predetermined pattern so that the forces applied by the rising or descending air currents to the panels cooperate rather than counterbalance one another and produce the desired rotational effect. For example, lower panel 54 on one side of the axis of rotation projects forwardly from the body 52 while adjacent lower panel 56 on the opposite of the axis projects rearwardly therefrom. The upper panel 58, adjacent to panel 56 projects forwardly while the remaining panel 60 projects rearwardly. All of the panels form an acute angle with a horizontal plane, preferably an angle of 45° as described above. They are all of substantially identical size and shape so that the disseminator 50 is properly balanced about a vertical axis. The disseminator 50 is supported from a vertical support, such as a hook 60, by a thread 62 as described above for relatively friction-free support.

The body 52 as well as the surfaces of the panels may contain information desired to be disseminated, for example, advertising. The relatively slow rotation produced by the vertically moving air currents is sufficient to provide the eye catching effect and yet is slow enough to permit the information to be fully digested and appreciated.

PREFERRED EMBODIMENT (FIGS. 3–6)

The presently preferred form of this invention is illustrated in FIGS. 3–6 wherein it is shown for use as an advertising medium. The disseminator 70 illustrated therein is formed of four evenly spaced display panels 72, 74, 76, 78 each of which forms an acute angle, preferably 45°, with the horizontal plane. While four display panels are shown, any number greater than one will enable the disseminator to rotate. However, for advertising three or four panels is preferred since this number will minimize panel overlap while providing an adequate number of reaction surfaces.

Figure 5:
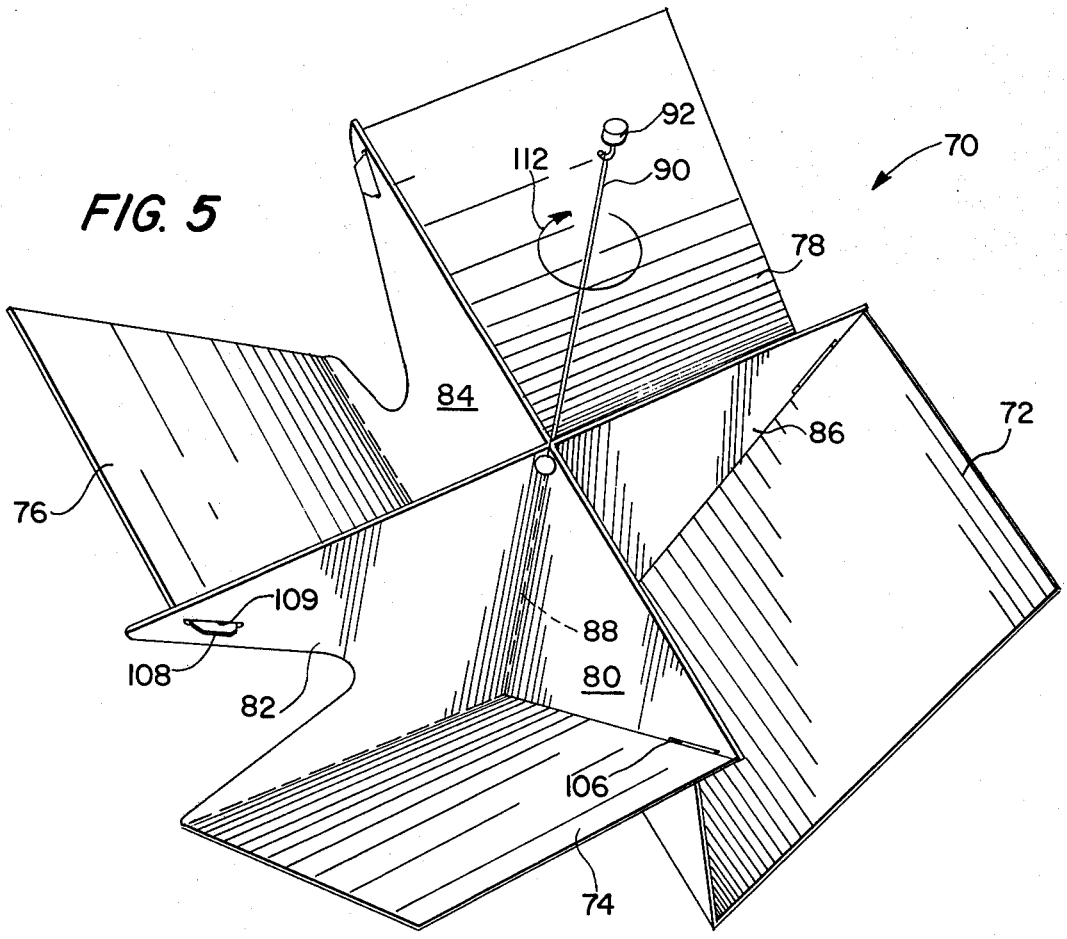
FIG. 5 is a perspective view looking downwardly upon the disseminator of FIG. 3.

As can be seen in FIG. 5, each of the panels 72, 74, 76, 78 projects outwardly from a body formed of vertical support panels 80, 82, 84, 86 respectively, which vertical support panels are joined together along a vertical axis 88. The disseminator 70 is supported for rotational motion about the vertical axis by a relatively friction-free support means, such as a thread 90 hung from a fixed support, for example a hook 92 attached to a ceiling.

Figure 6:
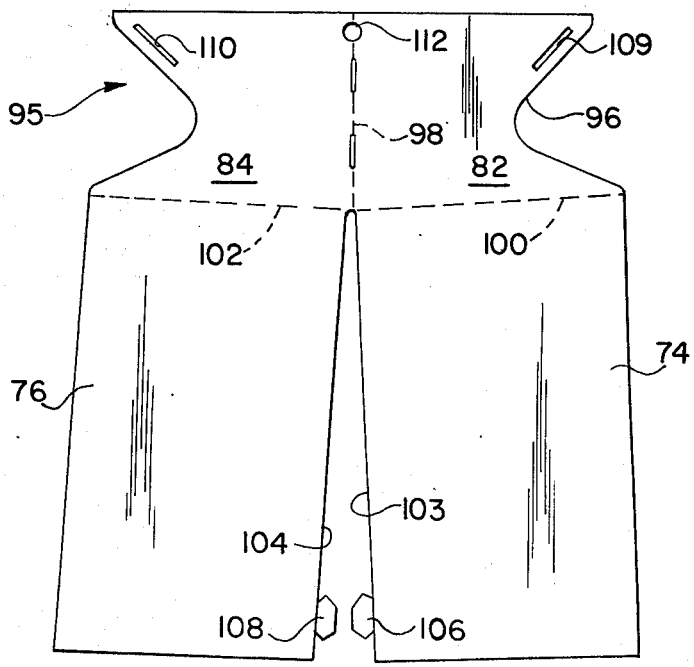
FIG. 6 is a blank form of the panels forming the disseminator of FIG. 3.

In accordance with this invention, the disseminator 70 may be easily formed from two identical planar or sheet members joined together back-to-back along their center line. As here embodied, both sheet members are identical and may be made of paperboard, plastic or other easily blanked out and foldable material. FIG. 6 illustrates one such sheet member 95 which is formed with an upper portion 96 bisected by a fold line 98 forming the support panels 82, 84. Extending downwardly from support panel 82 to display panel 74 while display panel 76 extends downwardly from support panel 84. The display panels 74, 76 are defined at their upper edge by fold lines 100, 102 respectively. The facing or interior edges 103, 104 of the display panels 74, 76 diverge or are shaped apart in order to provide them on their adjacent interior edges 103, 104 with tabs 106, 108 to be inserted into slots in an adjacent support panel as is described below. The support panel 82 is provided with a slit 109 while support panel 84 is provided with a slit 110. An opening 112 is provided through the upper edge of the upper section 96 to receive the thread 90 for supporting the disseminator 70.

Figure 3:
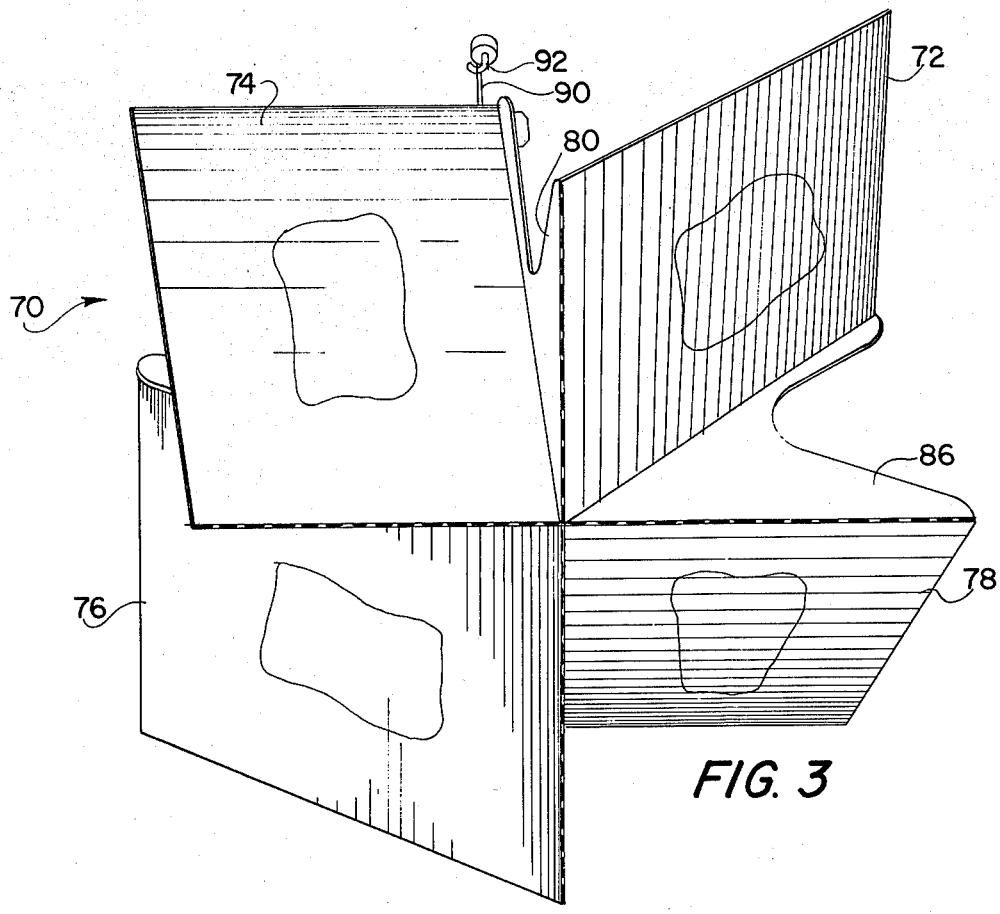
FIG. 3 is a perspective view of the preferred form of this invention as seen by a viewer standing beneath the disseminator.
Figure 4:
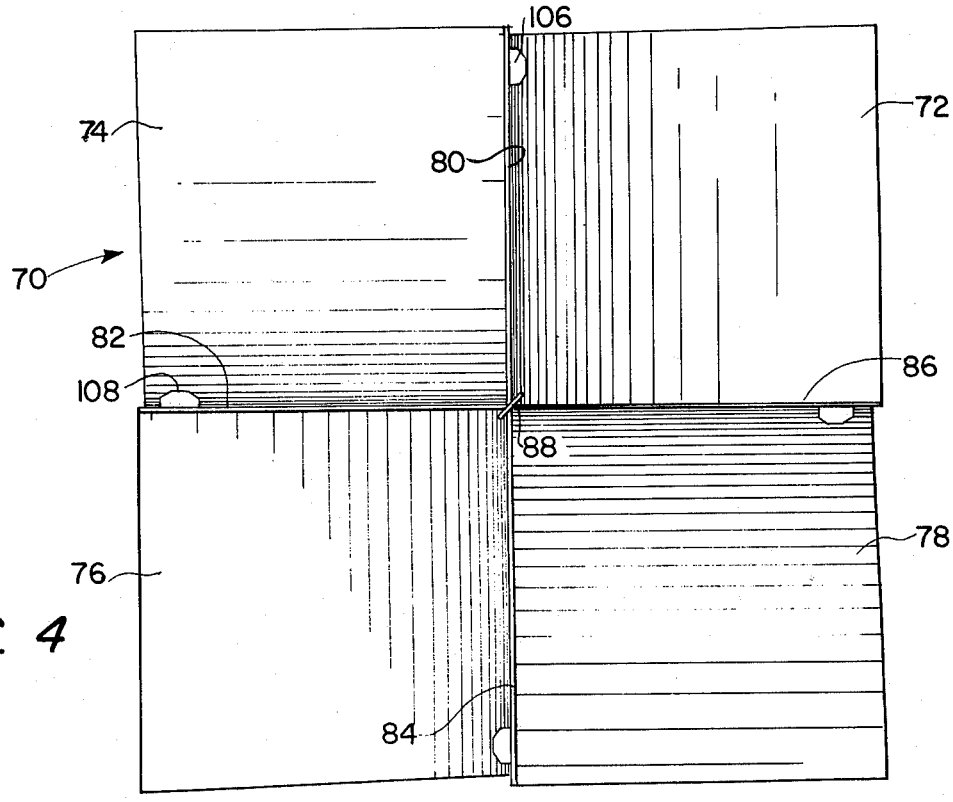
FIG. 4 is a top view of the disseminator of FIG. 3.

In order to form the disseminator 70 as shown in FIGS. 3–5 from the blank illustrated in FIG. 6, the upper section 96 is folded along fold line 98 while the display panel 76 is folded upwardly along its fold line 102 and the tab 108 is inserted into the slot 109 in the adjacent support panel 82. Similarly, the display panel 74 is folded upwardly along its fold line 100 and its tab 106 is inserted in the slot in its adjacent support panel 80 (see FIG. 5) and, similarly, each of the display panels 72 and 78 are similarly joined to their support panels 86, 84 respectively.

With this construction, it can be readily appreciated that the selfcontained rotary disseminator 70 can be easily manufactured by conventional sheet blanking equipment and the disseminator can be stacked and shipped in its flat, unfolded form as shown in FIG. 6 and assembled at its point of display. Once assembled and suspended from suitable support means, such as a hook 92, vertical air currents, even if extremely small, will apply an additive force on each of the display panels 72, 74, 76, 78 producing a torque which effects rotation of the disseminator in a clockwise direction as viewed in FIG. 5 and shown by the arrow 112.

As can be appreciated from the illustration in FIG. 3, each of the display panels 72, 74, 76, 78 provide a surface on which information to be disseminated, such as an advertisement, can be applied by any conventional means such as printing, laminating, etc. Indeed, since the disseminator 70 may be formed from a planar blank as shown in FIG. 6, it is ideally suited for printing or lamination by merely passing the blank 95 through conventional printing or laminating equipment on a conveyor belt. The relatively slow continuous rotation of the disseminator 70 attracts the viewer and yet permits complete reading of the printed material.

The disseminator of this invention can also be used for disseminating a vapor for eliminating unpleasant or characteristic odors such as tobacco odors or medicinal odors. With reference to the disseminator 50 illustrated in FIG. 2, there is illustrated a volatile liquid storage means 120 which permits controlled vaporization of the liquid. For example, a sponge 120 could be mounted in an opening 122 formed in the body 52 of the disseminator 50. The opening 122 can be formed by bending a pair of flaps, one of which can be seen at 124, in opposite directions to form the opening 122 and provide support for the sponge 120. The sponge 120 must be mounted centrally with respect to a vertical axis through the body 52 and support thread 62.

As the disseminator 50 rotates as described above, the vapor emitted by the sponge 120 is disseminated throughout the area surrounding the disseminator 50 as a result of the rotary air currents established by rotation of the disseminator 50. For example, by hanging a disseminator 50 above a hospital bed, the rising air currents produced by the patient lying in the bed will cause the disseminator 50 to rotate producing dissemination of the vapor emitted by the sponge 120.

It is obvious that a similar method could be used for mounting a sponge or other liquid reservoir on the disseminator 70 of FIGS. 3–5 or the disseminator 10 of FIG. 1.

SUMMARY

As can be seen from above and the drawings, this invention provides a disseminator which is rotated by extremely small vertically moving air currents which are generally available. The disseminator can be easily and inexpensively manufactured, can be stored and shipped in a flattened form providing maximum storage density, and can be easily assembled at point of usage. The disseminator is aesthetically attractive, is intriguing because of its continued unmotorized rotation even in relatively draft-free rooms. Its rotation provides the desired eye appeal for advertising purposes and generates lateral air currents for vapor disseminating purposes, such as for deodorizing an area.

What is claimed is:

1. A blank for forming a rotary disseminator comprising a pair of planar members each having an upper portion divided into equal first and second support panels by a first fold line, a third panel attached along a second fold line to said first support panel, a fourth panel attached along a third fold line to said second support panel, said third and fourth fold lines being transverse to said first fold line, and means for joining each of said third and fourth panels to an adjacent support panel other than the support panel to which it is attached, said planar members being joined together along said first fold line means on said disseminator for receiving rotatable support means.

2. A blank as defined in claim 1 wherein each of said third and fourth panels includes a tab and wherein each of said support panels includes a slot for receiving one of said tabs.

3. A blank for forming a rotary disseminator comprising a. a first planar member including first and second support panels joined together along a first longitudinal fold line, a third panel hingedly joined to said first support panel along a first transverse fold line, a fourth panel hingedly joined to said second support panel along a second transverse fold line, b. a second planar member including fifth and sixth support panels joined together along a second longitudinal fold line, a seventh panel hingedly joined to said first support panel along a third transverse fold line, an eighth panel hingedly joined to said sixth support panel along a fourth transverse fold line.

c. first means for joining said first and second planar members along said first and second longitudinal fold lines, d. second menas for attaching said third panel to said second support panel, said fourth panel to said fifth support panel, said seventh panel to said sixth support panel, said eighth panel to said first support panel, and e. means on said disseminator for receiving a rotatable support means.

4. A blank as defined in claim 3 wherein said second means comprises tabs extending from said third, fourth, seventh and eighth panels and slots in said second, fifth, sixth and first support panels for receiving said tabs respectively.

5. A blank for forming a rotary disseminator comprising a plurality of planar members each having an upper support panel joined to adjacent support panels of other said planar members along a first line, a lower panel attached along a fold line to each of said upper support panels, said fold line being transverse to said first line, and means for joining each of said lower panels to an adjacent upper support panel other than the support panel to which it is attached, and means on said disseminator for receiving a rotatable support means.

6. A blank as defined in claim 5 wherein each of said lower panels includes a tab and wherein each of said support panels includes a slot for receiving one of said tabs.

7. A flat blank for forming a rotary disseminator comprising:

a. a plurality of substantially identically shaped planar members each including a first support panel joined to adjacent support panels of other said planar members along a longitudinal line, and a second panel hingedly joined to said first support panel along a transverse fold line;

b. first means for joining said planar members along said longitudinal lines;

c. second means for attaching said second panel of each planar member to said first support panel of an adjacent planar member; and d. means on said disseminator for receiving a rotatable support means.

8. A blank as defined in claim 7 wherein said second means comprises a tab extending from each of said second panels and a slot in each of said first support panels for receiving the tab of said second panel of an adjacent planar member.

* * * * *